US007056183B2

(12) United States Patent
Pedoto

(10) Patent No.: US 7,056,183 B2
(45) Date of Patent: Jun. 6, 2006

(54) WORK AND PLAY STATION

(75) Inventor: Anna Pedoto, Rome (IT)

(73) Assignee: Umberto Ambrosini S.r.l., Rome (IT)

( * ) Notice: Subject to any disclaimer, the term of this patent is extended or adjusted under 35 U.S.C. 154(b) by 0 days.

(21) Appl. No.: 10/444,593

(22) Filed: May 23, 2003

(65) Prior Publication Data

US 2004/0002287 A1 Jan. 1, 2004

(30) Foreign Application Priority Data

May 29, 2002 (IT) ..... RM20020108 U

(51) Int. Cl.
*A63H 3/00* (2006.01)

(52) U.S. Cl. ..... 446/73; 446/75; 446/76; 434/429; 312/305

(58) Field of Classification Search ..... 434/408, 434/415–418, 429, 85; 446/71, 72, 73, 75, 446/76, 487, 482, 491; 312/330.1, 305, 125, 312/249.11; 5/503.1, 507.1, 658
See application file for complete search history.

(56) References Cited

U.S. PATENT DOCUMENTS

| | | | | |
|---|---|---|---|---|
| 1,066,006 | A * | 7/1913 | Forgy | 312/210.5 |
| 1,678,088 | A * | 7/1928 | Sideman | 312/135 |
| 1,686,291 | A | 10/1928 | Moore | |
| 2,072,511 | A * | 3/1937 | Ross | 84/470 R |
| 2,740,684 | A * | 4/1956 | Haralson | 312/319.5 |
| 3,558,206 | A * | 1/1971 | Erickson | 312/290 |
| 3,698,779 | A * | 10/1972 | Holmes et al. | 312/126 |
| 4,046,437 | A | 9/1977 | Caron et al. | |
| 4,057,244 | A * | 11/1977 | Gaspar | 472/126 |
| 4,697,856 | A * | 10/1987 | Abraham | 312/305 |
| 4,784,382 | A * | 11/1988 | Myers | 248/460 |

FOREIGN PATENT DOCUMENTS

| | | |
|---|---|---|
| DE | 200 19 509 | 5/2001 |
| FR | 926 044 | 9/1947 |
| FR | 2 590 463 | 5/1987 |
| FR | 2590463 A1 * | 5/1987 |
| FR | 2 598 306 | 11/1987 |
| FR | 2 613 918 | 10/1988 |
| FR | 2 655 826 | 6/1991 |
| GB | 2 357 237 | 6/2001 |

OTHER PUBLICATIONS

EPO Search Report.

* cited by examiner

*Primary Examiner*—Bena Miller
(74) *Attorney, Agent, or Firm*—Hedman & Costigan; James V. Costigan

(57) ABSTRACT

The present invention relates to a work and study station comprising an upper part and a lower part (1), said upper part (2) substantially comprising the container of the graphical and modelling instruments, and said lower part (2) substantially comprising the resting and work station.

20 Claims, 6 Drawing Sheets

WORK AND PLAY STATION

The present invention relates to a work and play station.

More specifically, the invention concerns to a work and play station suitably studied to conciliate the amusement and application necessity for a child.

Particularly, the station suggested according to the present invention has been studied in such a way to be considered by a child as a "friend" to play with, and at the same time a solution allowing to stimulate his/her fantasy and its application for play and work activity (study, coloration, etc.)

During the years, many solutions have been suggested aiming to provide to the children, and consequently to the parents, instruments allowing to stimulate in an optimum way the child, both to allow him/her to play, and to put him/her to study in the most convenient way without dramatising the relation with the study.

In this situation, it is included the solution suggested according to the present invention aiming to conciliate all the above mentioned needings.

Particularly, object of the present invention is that of providing a work and study station that can be "adopted" by the child as faithful study and play friend.

Another object of the present invention is that of providing a product that is very flexible, and thus can allow different use configurations for playing and studying.

Still another object of the present invention is that of providing a solution that can be use as bedside table, as table to colouring and playing, as well as a desk to make home works.

These and other results are obtained according to the present invention by a work and study station studied for children 3/4–10/11 year old, provided with all is necessary to carry out graphical and play/creative activities.

It is therefore specific object of the present invention a work and study station comprising an upper part and a lower part, said upper part substantially comprising the container of the graphical and modelling instruments, and said lower part substantially comprising the resting and work station.

Preferably, according to the invention, said upper part provides planes and/or compartments and/or drawers.

According to a particularly preferred embodiment of the work station according to the invention, said upper part has a substantially spherical shape, comprised of two hemispherical calottes, one of which is fixed and the second one rotating.

Particularly, said hemi-parts are preferably comprised of different materials.

Still according to the invention, noise or music activated LED can be provided on said upper part, said LED preferably comprising the eyes of a robot.

Furthermore, according to the invention, it can be provided a knob to open said two hemi-parts of the upper part, said knob preferably comprising the tongue of a robot.

Preferably, according to the invention, said planes and/or compartments and/or drawers are rotatable, thus allowing an easy access to each one of them.

Always according to the invention, on said upper part two arms can be provided, that can represent the antennae of a robot, bearing environment lights, and/or a camera, preferably rotating about a vertical and horizontal axis, and/or a light, possibly associated to the camera, and/or a image projector, and/or acoustic diffusers.

Furthermore, according to the invention, said lower part, preferably having a substantially parallelepiped shape, can provide a base and a central space.

Preferably, a motor, supply batteries can be provided in said basis, and at the bottom of the same, wheels for moving the work and study station.

In a particularly preferred embodiment of the work and study station according to the invention, said lower part provides foldable planes, hinged to the structure, and possibly provided with further extension planes, and lateral pockets, also hinged to the structure, to support said planes.

Still according to the invention, said lower part provides a stool, preferably obtained from the surface of the closure vertical panel.

Further, according to the invention, said lower part of the work and study station can provide a CD drive and/or cassette drive and/or a radio and/or a clock and/or light switches, and/or an electronic keyboard for an electronic computer.

Particularly, according to the invention, said work and study station can provided with sound affects for opening and closure of the various parts.

Still according to the invention, said station can be provided with a remote control, possibly with microphone.

Always according to the invention, it can be further provided a image projector for the transfer on a paper support.

The present invention will be now described, for illustrative but not limitative purposes, according to its preferred embodiments, with particular reference to the figures of the enclosed drawings, wherein.

Figure 1:
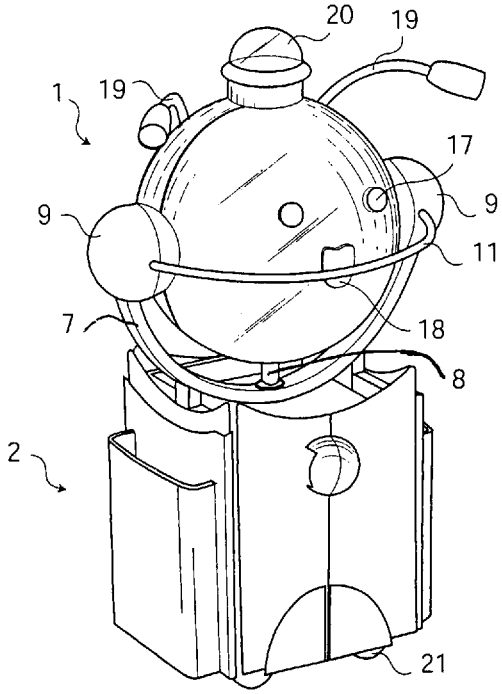
FIG. 1 is a front perspective view of a work and study station according to the invention.
Figure 2:
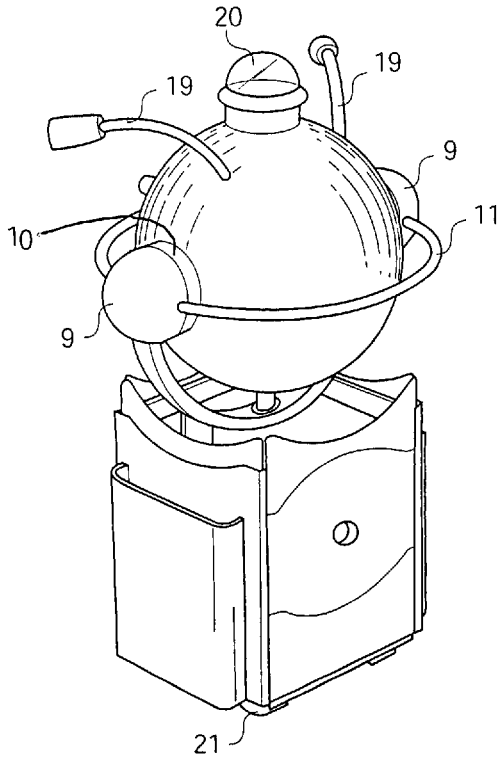
FIG. 2 is a rear perspective view of the work and study station of FIG. 1.
Figure 3:
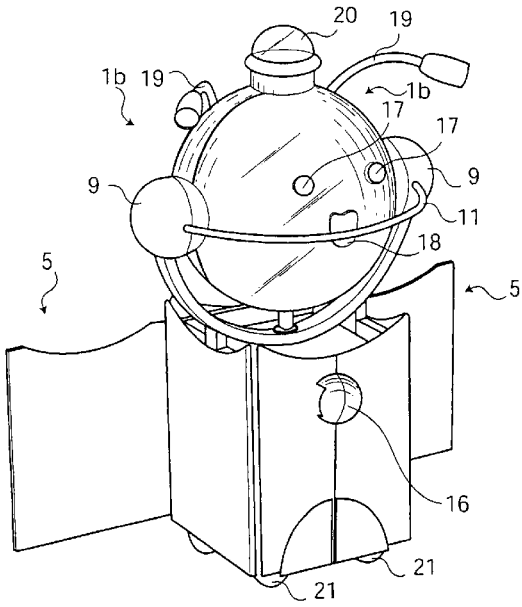
FIG. 3 is a second front perspective view of a work and study station of FIG. 1 with some elements open.

The work and study station that will be described with reference to the enclosed drawings provides the combination of various technical solutions. It is well evident that said combination must not be considered as limitative of the scope of the invention, but only as illustrative of some, and of all, the possible combinations provided by the inventive solution.

Making first reference to the figures of the enclosed drawings, it is shown a first embodiment of the work and study station according to the invention, substantially providing an upper part 1, preferably having a spherical shape, used as container of the graphic and modelling instruments, and a lower part 2, having a substantially parallelepiped shape, provided with two overturning working planes 3, a stool 4 and two outer pockets 5, with the double function of support both of planes and containers.

Said stool 4 can also be frontally housed within the lower parallelepiped. In this case, the front doors are open and the stool is introduced between the CD driver and the motor housing, in the central space, in a laid-down position with the legs perpendicular to the inner surface of the rear panel. The position is exactly that of the solution shown in the drawings, but diametrically opposed. On the outer surface of the rear panel, a chalk board will be introduced.

Observing particularly the upper part 1, it is comprised of two hemispherical calottes, made up of different material; one of them, 1*a*, is movable, rotating about the vertical axis of 360° within the other one, 1*b*, the latter being fixed to the station support structure, and realises the closure of a spherical-shape container space.

On the outer surface of the upper part 1, two eyes 17 are provided, with noise and music activated LED, and a knob-tongue 18, to make the opening easier.

Figure 9:
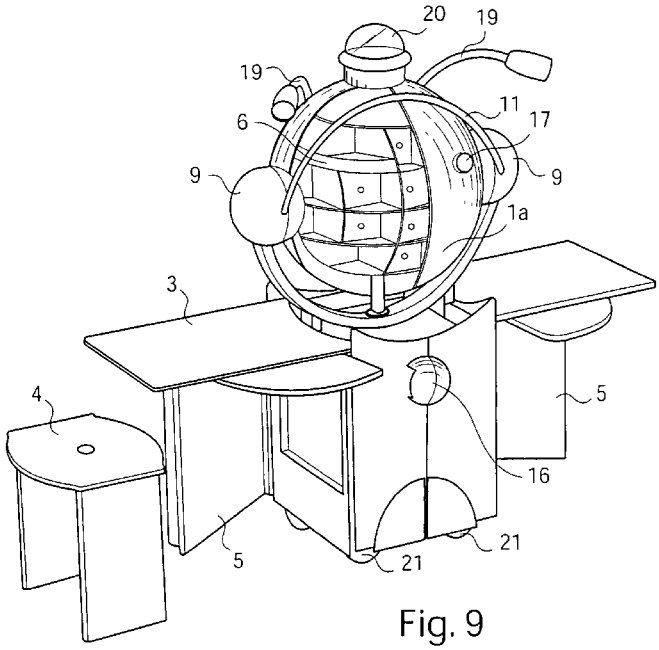
FIG. 9 is a further front perspective view of a work and study station of FIG. 1 in a further use configuration.
Figure 10:
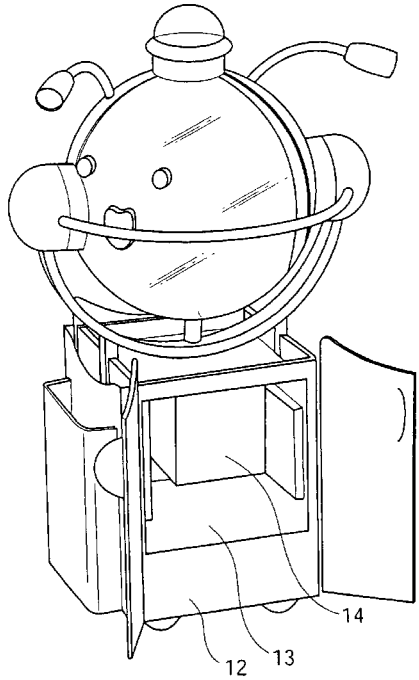
FIG. 10 is a sixth front perspective view of a work and study station of FIG. 1 in a further use configuration.
Figure 11:
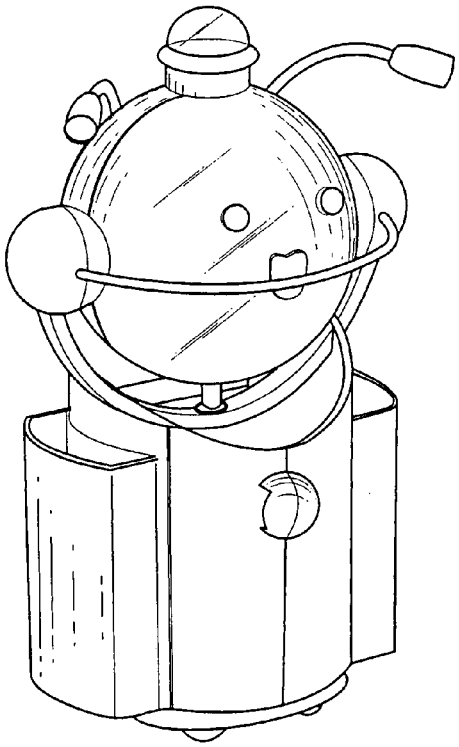
FIG. 11 is a first front perspective view of further embodiment of the work and study station according to the invention.
Figure 12:
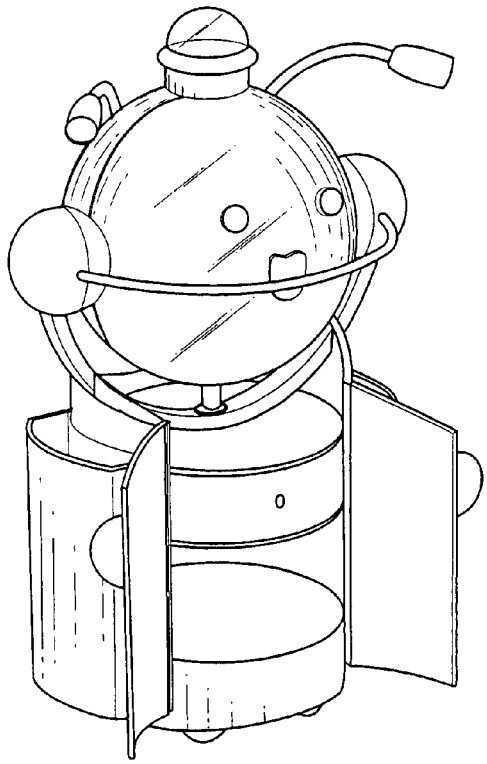
FIG. 12 is a second front perspective view of the work and study station of FIG. 11 .

Inner space of the upper part 1 is occupied by a plane and compartments system 6 (see particularly FIG. 9), comprised of horizontal and vertical circles, having different diameter, and rotating about the vertical axis.

Said plane system 6, conforming to the spherical shape and using at best the available space, is provided with drawers (twelve in the shown embodiment), that have different length and colour and that can be used on both the sides, rotating the planes. Said drawers are fully extractable, and contain, according to their length, pencils, felt-pans, water-colours and brushes, crayons, modelling paste, rubbers, pencil-sharpener, and like.

The fixed hemi-spherical calottes l*b* is provided at the above with two flexible antennae 19, used as directional lamps aimed to the lightening of the working planes or as small variable intensity environment lights.

In the central position, between the two "antennae" 19, a camera 20 is placed, rotating about the vertical and horizontal axis and remote controlled by a radio control.

Centrally, associated with the camera 20, a room light and/or a small projector able to project on the ceiling the hour and other images.

Said hemi-sphere 1*b* is laterally fixed, along the horizontal diameter, to a hemi-circular support arc 7 having its convexity downward faced.

Two further fixing elements, that are diametrically opposed each other, are along the vertical axis of the hemisphere 1*b*, in a tube 8 fixed at the bottom to the arc 7 and acting as support and rotation axis for the inner plane system.

At the ends of the arc 7 two one or two way acoustic diffusers 9 are hooked, having a diameter of 8–10 cm, enclosed within two hemispherical calottes, hooked to the support arc 7 and to the main calottes 1*b* by joint cylindrical spacers 10.

A square- or round-section horizontal ring 11 is fixed to the two calottes of the acoustic diffusers 9, the half of which can be overturned to allow an easy access to the drawers.

The support arc 7 is fixed to the structure of the lower parallelepiped part.

Within all the support structure the electrical cables pass.

The parallelepiped lower part 2 is comprised of abase 12., containing the transmission means of the radio controlled motion and the 12V rechargeable batteries. Motion occurs by two rubberized wheels 21. Said parallelepiped lower part 2 has a containing central space 13, and a CD driver 14, a clock, having wake up function, and the light switches.

Figure 4:
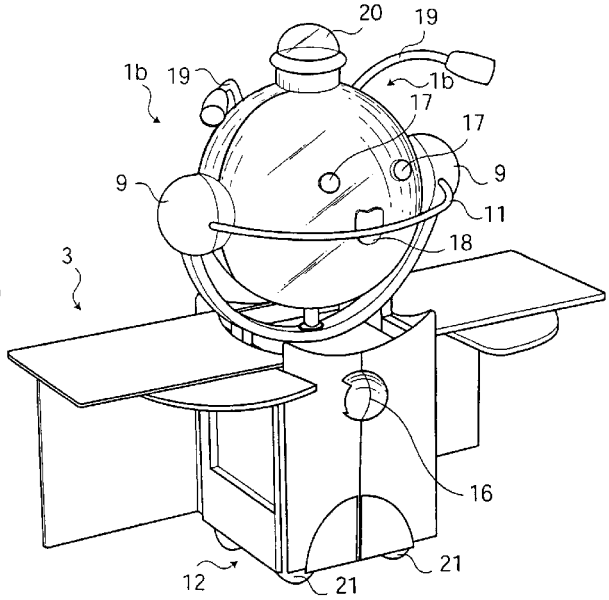
FIG. 4 is a third front perspective view of a work and study station of FIG. 1 with some further elements open.
Figure 5:
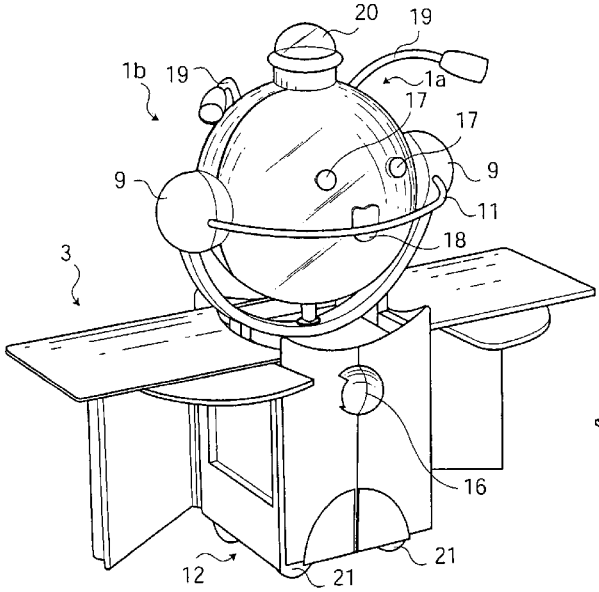
FIG. 5 is a fourth front perspective view of a work and study station of FIG. 1 with some further elements open.
Figure 6:
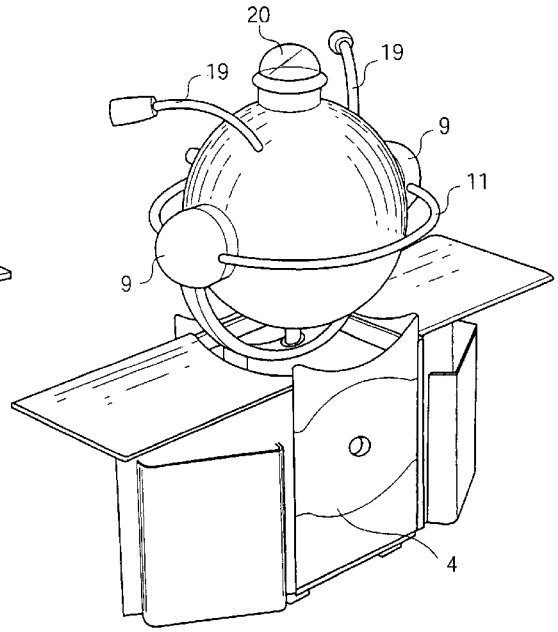
FIG. 6 is a rear perspective view of the work and study station of FIG. 1 when in the configuration of FIG. 5.
Figure 7:
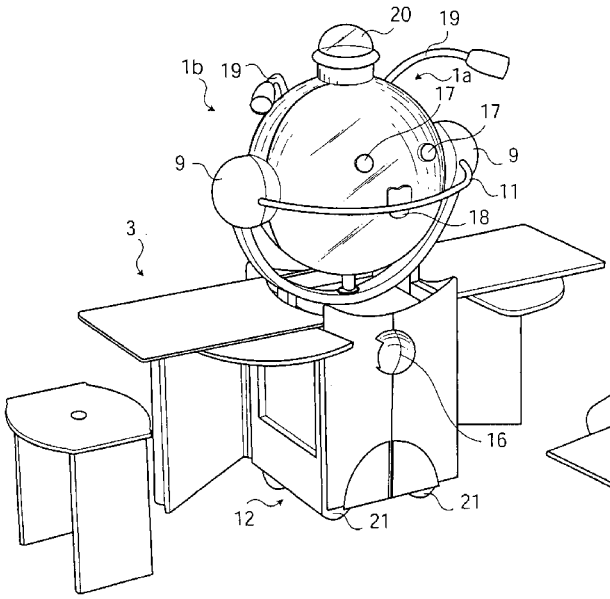
FIG. 7 is a fifth front perspective view of a work and study station of FIG. 1 with some further elements open.
Figure 8:
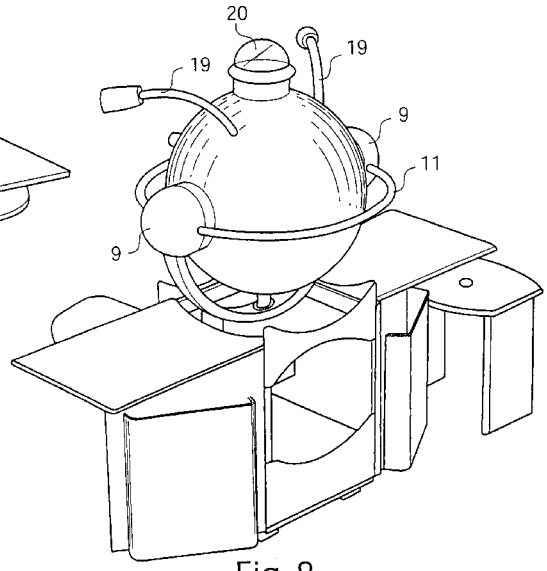
FIG. 8 is a rear perspective view of the work and study station of FIG. 1 when in the configuration of FIG. 7.

At the top of the parallelepiped lower part 2, the two overturning planes 3 are hinged, acting, once open, as working planes, with the possibility of extending their useful surface by supplemental parts coupled to the same (see figure 4).

Planes rest on the two outer pockets 5, laterally hinged to the structure, and, once open, to allow the overturning of the planes 3, are partially closed under the same; an extractable foot guarantees the rest on the ground of the outer pockets 5.

An electronic keyboard is connected to one of the planes 3, that can be used above the same plane 3, or released and used in another position.

The central containing space 13 is closed by two front ante 15 provided with handles 16, obtained by two quarters of sphere.

The opening and the closure of the wings 15, of the lateral planes 3, of the outer pockets 5, of the hemisphere of the upper part are evidenced by sound effects.

Within the lower container 2, the removable CD driver is provided, that can be used also as portable driver by employing acoustic headsets. Furthermore, it can be provided the seat for the insertion of a small electronic computer (not shown) provided with LCD screen, that can be coupled with the camera to take and elaborate images. Computer will be provided with didactic and play programs.

On the rear of the container 2, a stool 4 is placed, the seat of which is obtained from the surface of the closure vertical panel. Legs enter perpendicularly to the back, adhering to the inner sides of the container 2; to be used, it is horizontally extracted and rotated in a vertical position.

Movements of the station according to the invention are controlled by a radio-control provided with microphone to transmit voice messages to the diffusers integrated with the work station. By the remote control, also the camera 20 is controlled; images are transmitted to the standard house TV set.

A further instrument is an image projector (not shown) for transfer on paper support.

Work and play station according to the invention can also be used as furnishing of the room, only with minor modifications.

In case it is placed near to the desk, it is a useful container for drawing and writing accessories; near the sofa in the living room, it is a magazine holder, a small mobile bar, tables can give a useful service support; it can be moved by the radio-control, have a room light and directional lights for reading, contain a small HI-FI, CD, DVD system. It could also be provided with sockets for the coupling with the computer and register MP3 music.

If it is provided in the sleeping room, it can be a bedside table provided with clock radio, CD driver, with two rest planes, it can contain the slippers, books and magazines.

In the kitchen, it can be useful as radio-controlled food holder carriage, spices and seasonings, holder, flatware, serviettes holder, support for kitchen books, cutting table, kitchen paper roll, etc.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. Work and study station comprising an upper part and a lower part, wherein said upper part is substantially spherically shaped by two hemispherically shaped calottes, a first fixed calotte and a second calotte rotatable within said first calotte, said upper part being integral with said lower part, said upper part housing having within said first and second calotte, one or more horizontal planes conforming to said hemispherical shape of said first and second calotte, said one or more horizontal planes being dissected by one or more vertical planes forming spaces of various sizes, said lower part comprising a substantially parallelepiped shape base and a central space within said base, said upper part being affixed at opposing points along an equator to a support arc that extends from said opposing points around lower half of said upper part which are integral with said lower part at a midpoint of said support arc and having a tube fixed at the bottom of said arc, said tube being a support and rotation axis for said one or more horizontal planes.

2. Work and study station according to claim 1, wherein said spaces of various sizes of said upper part includes drawers having dimensions that conform to said spaces, said drawers being accessible when said second calotte rotates within said first calotte.

3. Work and study station according to claim 1, wherein said first and second calotte of said upper part are comprised of different materials.

4. Work and study station according to claim 1, wherein said spaces are rotatable within said upper part, allowing an easy access to each one of them.

5. Work and study station according to claim 4, wherein said vertical and horizontal planes are rotatable within said upper part, allowing easy access to each one of them.

6. Work and study station according to claim 1, wherein said base further comprises a motor, and an area for batteries for said motor, and said base having wheels for moving said work and study station.

7. Work and study station according to claim 1, wherein said lower part further comprises an area adapted for storing a stool having legs so that when said legs of said stool are stored in said area, said lees are integrated vertically within said area of said base.

8. Work and study station according to claim 7, wherein said area adapted for storing said stool is adapted to store a seal on said stool within said parallelepiped shaped base.

9. Work and study station according to claim 1, wherein on an outer surface of a rear panel of said base a chalk board is inserted.

10. Work and study station according to claim 1 comprising an upper part and a lower part, wherein said upper part is substantially spherically shaped by two hemispherically shaped calottes, a first fixed calotte and a second calotte rotatable within said first calotte, said upper part being integral with said lower part, said upper part housing having within said first and second calotte, one or more horizontal planes conforming to said hemispherical shape of said first and second calotte, said one or more horizontal planes being dissected by one or more vertical planes forming spaces of various sizes, said lower part comprising a substantially parallelepiped shape base and a central space within said base, wherein said lower part of said work and study station further comprises light switches.

11. Work and study station according to claim 1 comprising an upper part and a lower part, wherein said upper part is substantially spherically shaped by two hemispherically shaped calottes, a first fixed calotte and a second calotte rotatable within said first calotte, said upper part being integral with said lower part, said upper part housing having within said first and second calotte, one or more horizontal planes conforming to said hemispherical shape of said first and second calotte, said one or more horizontal planes being dissected by one or more vertical planes forming spaces of various sizes, said lower part comprising a substantially parallelepiped shape base and a central space within said base, wherein said station is provided with a remote control, and optionally a microphone.

12. Work and study station according to claim 1, wherein said work and study station further comprises an image projector.

13. Work and study station according to claim 1, wherein said upper part contains vacant spaces, and said spaces are accessible when said second calotte is rotated within said first calotte.

14. Work and study station according to claim 1, having at least four horizontal planes.

15. Work and study station according to claim 1, wherein said lower part further comprising at least two foldable wing shaped planes hinged to extend horizontally from said base and having extension planes extending from said foldable wing shaped planes, and at least two lateral pockets also hinged to said base which are extendable to a position below said foldable wing shaped planes to support said extension planes when said extension planes are extended to a position over said pockets.

16. Work and study station comprising an upper part and a lower part, wherein said upper part is substantially spherically shaped by two hemispherically shaped caloftes, a first fixed calotte and a second calotte rotatable within said first calotte, said upper part being integral with said lower part, said upper part housing having within said first and second calotte, one or more horizontal planes conforming to said hemispherical shape of said first and second calotte, said one or more horizontal planes being dissected by one or more vertical planes forming spaces of various sizes, said lower part comprising a substantially parallelepiped shape base and a central space within said base, wherein said upper part is affixed at opposing points along an equator to a support arc that extends from said opposing points around lower half of said upper part which are integral with said lower part at a midpoint of said support arc, wherein said second calotte has at least two exterior circular shaped light emitting displays adjacent to each other that are located above said points where said support arc is affixed to said upper part, said light emitting displays monitor a music device of said work and study station, said upper part being affixed at opposing points along an equator to a support arc that extends from said opposing points around lower half of said upper part and having a tube fixed at the bottom of said support arc, said tube being a support and rotation axis for said one or more horizontal planes.

17. Work and study station according to claim 16, wherein said second calotte further comprises on its exterior a knob located midway between said points where said support arc is affixed to said upper part, said knob being adapted to open rotatably said two hemispherically shaped calottes.

18. Work and study station according to claim 16, wherein said first fixed calotte comprises two laterally extendable antennae affixed at a point above said points where said support arc is affixed to said upper part, said extended antennae having environment lights attached to a terminal end of said extended antennae.

19. Work and study station comprising an upper part and a lower part, wherein said upper part is substantially spherically shaped by two hemispherically shaped calottes, a first fixed calotte and a second calotte rotatable within said first calotte, said upper part being integral with said lower part, said upper part housing having within said first and second calotte, one or more horizontal planes conforming to said hemispherical shape of said first and second calotte, said one or more horizontal planes being dissected by one or more vertical planes forming spaces of various sizes, said lower part comprising a substantially parallelepiped shape base and a central space within said base, wherein said upper part further comprises a camera, attached at a point on said upper part which is opposite a point where said support arc is integral with said lower part.

20. Work and study station according to claim 19, wherein said upper part further comprises a light attached at a point on said upper part which is opposite said point where said support arc is integral with said lower part.

* * * * *